US008858042B2

(12) United States Patent
Chang et al.

(10) Patent No.: US 8,858,042 B2
(45) Date of Patent: Oct. 14, 2014

(54) DETACHMENT-RESISTANT SHELL OF LIGHT BULB

(75) Inventors: Li-Chuh Chang, Taipei (TW); Jung-Kun Huang, Taipei (TW)

(73) Assignee: Crownmate Technology Co., Ltd., Taipei (TW)

( * ) Notice: Subject to any disclaimer, the term of this patent is extended or adjusted under 35 U.S.C. 154(b) by 162 days.

(21) Appl. No.: 13/425,693

(22) Filed: Mar. 21, 2012

(65) Prior Publication Data

US 2013/0250583 A1 Sep. 26, 2013

(51) Int. Cl.
*F21V 21/00* (2006.01)

(52) U.S. Cl.
USPC ..... 362/374; 362/362

(58) Field of Classification Search
CPC ..... F21V 17/18; F21V 17/164; F21V 17/10; F21V 17/101; F21V 17/102; F21V 17/104; F21V 17/105; F21V 17/106; F21V 17/107; F21V 17/108; F21V 17/12; F21V 17/14; F21V 17/16; F21V 17/162; F21V 17/166; F21V 17/168; F21V 31/005; F16B 39/30; F16B 39/32; F16B 39/38; F16B 39/286
USPC ..... 362/362, 374, 375
See application file for complete search history.

(56) References Cited

U.S. PATENT DOCUMENTS 6,338,565 B1 * 1/2002 Fager et al. ..... 362/363
2012/0063864 A1 * 3/2012 Hess ..... 411/326

* cited by examiner

*Primary Examiner* — Andrew Coughlin
(74) *Attorney, Agent, or Firm* — Bacon & Thomas, PLLC

(57) ABSTRACT

A detachment-resistant shell of light bulb includes a base and a cover. The base has a lower end forming a first coupling section where has a thread is circumferentially formed. The cover has an upper end forming an opening that forms a second coupling section where has a counterpart thread is circumferentially formed to correspond to and be engageable with the thread. The second coupling section has forms at least one resiliently deflectable member which is provided with a counterpart tooth that corresponds to and is engageable with the teeth of the base. The counterpart tooth includes a counterpart straight side corresponding to the straight side of the teeth and is selectively engageable with the straight side of one of the teeth to constrain reverse rotation.

8 Claims, 4 Drawing Sheets

DETACHMENT-RESISTANT SHELL OF LIGHT BULB

FIELD OF THE INVENTION

The present invention relates to a shell of light bulb, and in particular to a detachment-resistant shell of light bulb.

BACKGROUND OF THE INVENTION

A conventional light bulb, especially a light bulb with an assembled shell, comprises a shell that is composed of a base and a cover (not shown). The base has a lower open end and the cover has an upper open end, both open ends being coupled to each other through application of adhesives so that the cover is assembled to the lower open end of the base.

The bulb shell that is formed by adhesively coupling components is problematic in that the adhesive may get deteriorating and thus components may get detached from each other. In other words, the cover may get detached and falls down. If the cover is made of glass, it may be even more dangerous. Further, if such a light bulb is used in an extraordinary location where humidity is heavy, the electronic components inside the light bulb may get corroded or if the light bulb is used in a site where corrosive gases may exist (such as a location where animals gather and droppings of the animals induces corrosive gases such as ammonia and hydrogen sulfide), the internal components of the light bulb may similarly get corroded.

Thus, the present invention aims to provide a detachment-resistant shell of light bulb that overcomes the above problems.

SUMMARY OF THE INVENTION

The primary object of the present invention is to provide a detachment-resistant shell of light bulb, which comprises a base and a cover that are relatively rotatable for screwing engagement with each other and comprise a unique structure that prevents the shell of the light bulb from reverse rotation so as to provide the shell of light bulb with a detachment-resistant feature.

To achieve the above object, the present invention provides a detachment-resistant shell of light bulb, which comprises a base and a cover. The base has a lower end forming an opening around which a first coupling section is circumferentially formed. The first coupling section has a side face around which a thread is circumferentially formed. The first coupling section has a top face on which a plurality of teeth is formed and distributed circumferentially. Each of the teeth has a straight side. The cover has an upper end forming an opening that forms a second coupling section corresponding to and engageable with the first coupling section. The second coupling section has a counterpart side face that corresponds to the side face and around which a counterpart thread is circumferentially formed to correspond to and be engageable with the thread. The second coupling section has a counterpart top face that corresponds to the top face and forms at least one resiliently deflectable member. The resiliently deflectable member is provided with a counterpart tooth that corresponds to and is engageable with the teeth. The counterpart tooth includes a counterpart straight side corresponding to the straight side. The counterpart straight side of the counterpart tooth is selectively engageable with the straight side of one of the teeth to constrain reverse rotation.

As such, the cover is prevented from reverse rotation so that the bulb shell is protected against detachment and even falling down.

Further, the present invention provides a detachment-resistant shell of light bulb, which further comprises an O-ring mounted between the first coupling section of the base and the second coupling section of the cover. As such, due to the detachment resistance of the bulb shell, the mating engagement between the base and the cover is secured and the O-ring realizes protection against invasion of water and leakage so that humidity and water are prevented from entering the bulb. Thus, even in an application in which heavy humidity or corrosive gas exists, a light bulb comprising the bulb shell according to the present invention may protect electronic components contained in the bulb from being corroded and damaged.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
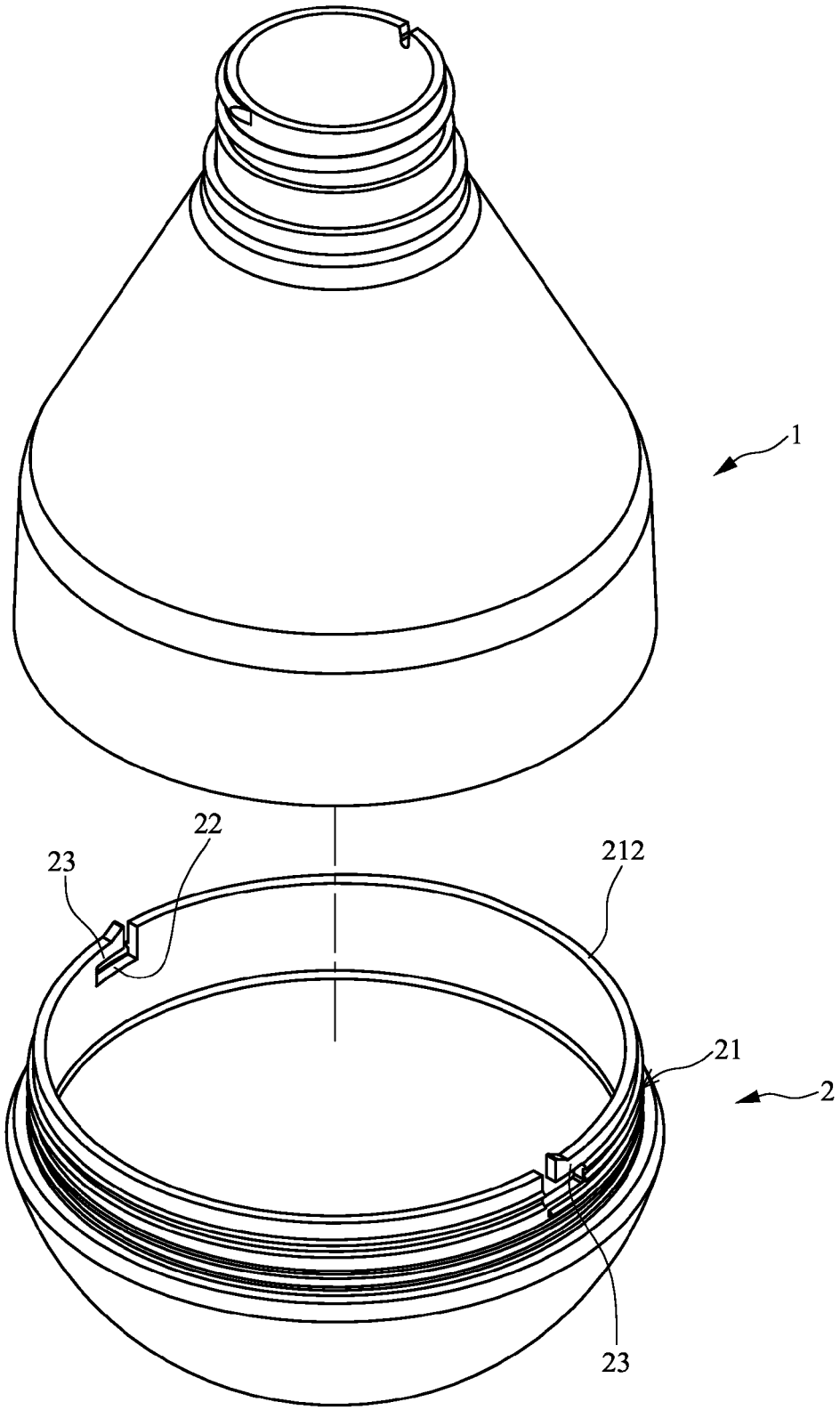
FIG. 1 is an exploded view showing a shell of light bulb according to the present invention.
Figure 2:
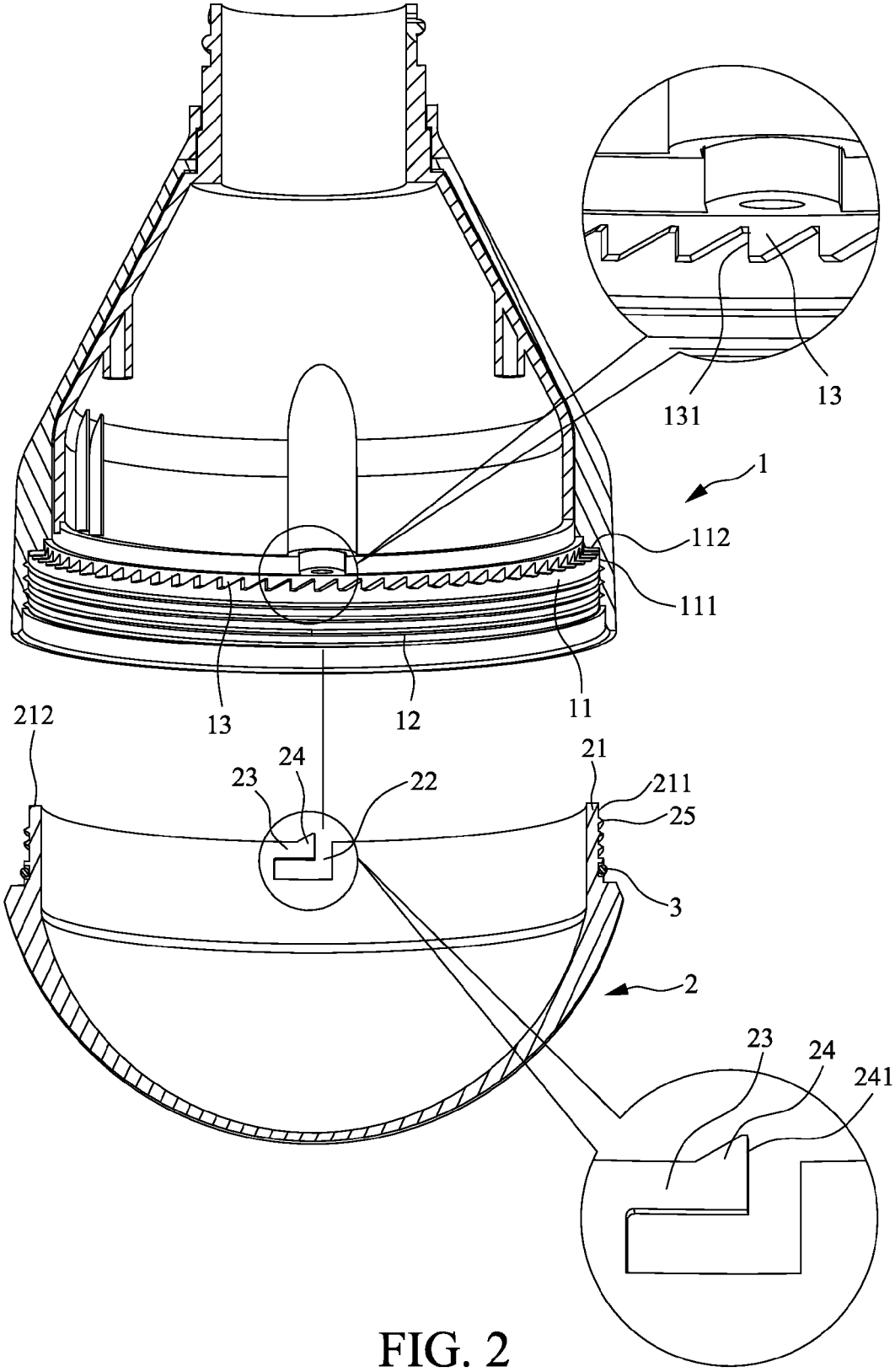
FIG. 2 is a cross-sectional view, in an exploded form, of the shell of light bulb according to the present invention.
Figure 3:
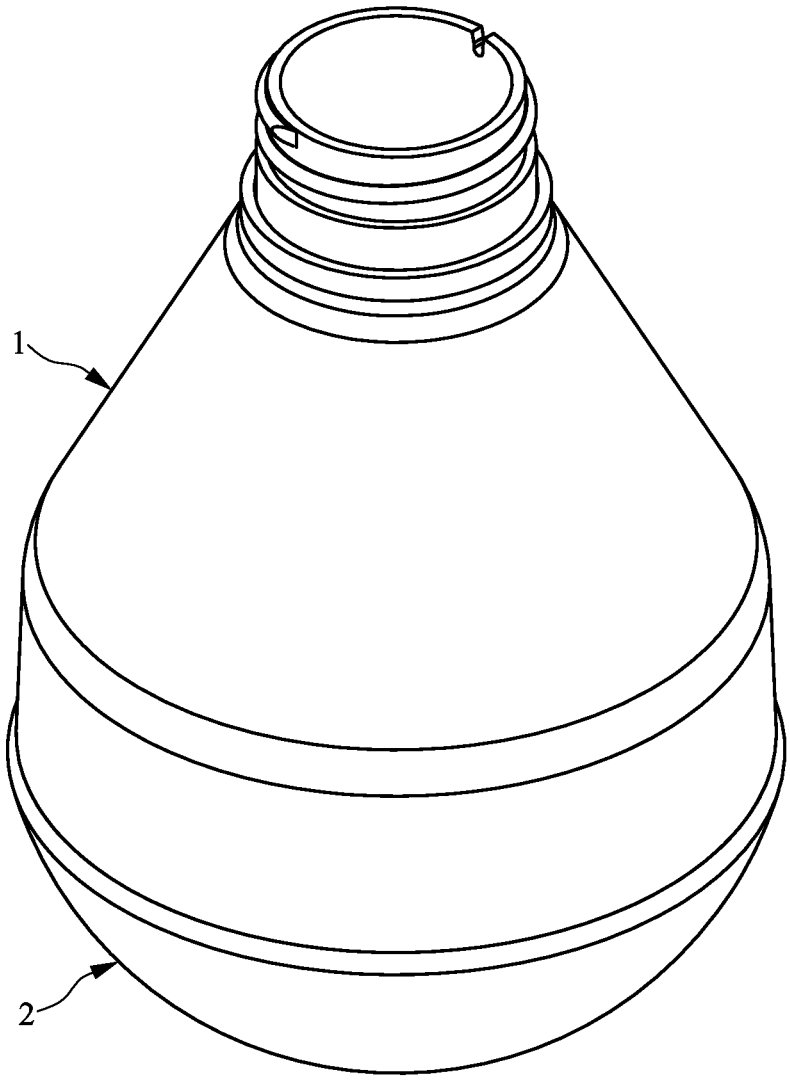
FIG. 3 is a perspective view, in an assembled form, showing the shell of light bulb according to the present invention.
Figure 4:
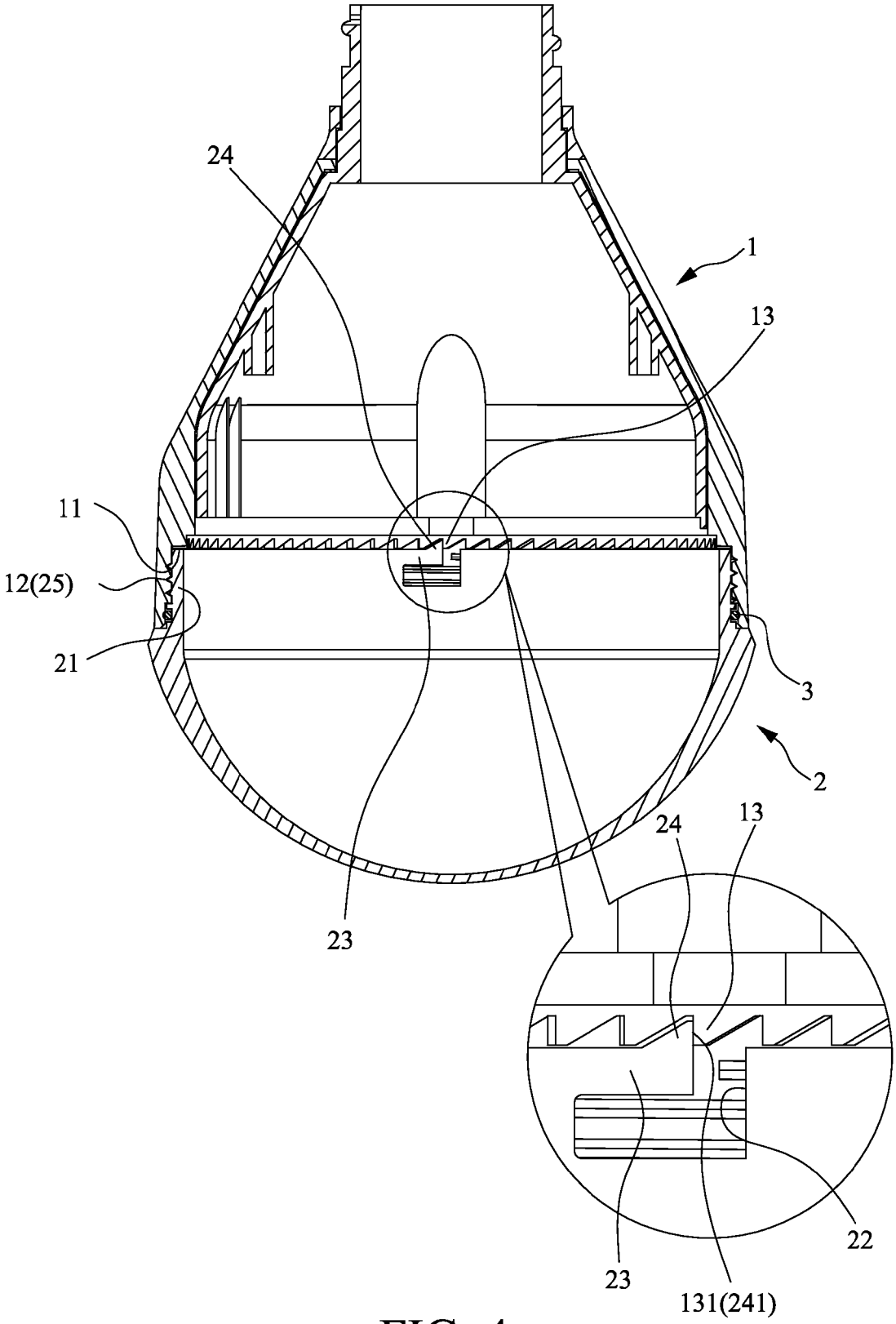
FIG. 4 is a cross-sectional view of the shell of light bulb shown in FIG. 3.

With reference to the drawings and in particular to FIGS. 1-4, the present invention provides a detachment-resistant shell of light bulb, which comprises a base 1 and a cover 2.

The base 1 has a lower end forming an opening around which a first coupling section 11 is circumferentially formed. The first coupling section 11 has a side face 111 around which a thread 12 is circumferentially formed. (As shown in the drawings, the side face 111 is an inside surface and the thread 12 is an inner thread; it is apparent that they can alternatively be an outside surface and an outer thread, which are shown in the drawings.) The first coupling section 11 has a top face 112 on which a plurality of teeth 13 is formed and distributed circumferentially. These teeth 13 are inclined in the same direction and each of the teeth 13 has a straight side 131. As shown in the drawings, the teeth 13 are right triangles, each of which also comprises a hypotenuse and a base.

The cover 2 has an upper end forming an opening that forms a second coupling section 21 corresponding to and engageable with the first coupling section 11. The second coupling section 21 has a counterpart side face 211, which corresponds to the side face 111 of the base 1 and around which a counterpart thread 25 is circumferentially formed. The counterpart thread 25 corresponds to and is engageable with the thread 12 of the base 1. (As shown in the drawings, the counterpart side face 211 is an outside surface and the counterpart thread 25 is an outer thread; it is apparent that they can alternatively be an inside surface and an inner thread, which are not shown in the drawings.) The second coupling section 21 has a counterpart top face 212 that corresponds to the top face 112 of the base 1 and forms at least one resiliently deflectable member 23. The resiliently deflectable member 23 is provided with a counterpart tooth 24 that corresponds to and is engageable with the teeth 13. The counterpart tooth 24 comprises a counterpart straight side 241 corresponding to the straight side 131 of the teeth 113. The counterpart straight side 241 of the counterpart tooth 24 is selectively engageable with the straight side 131 of any one of the teeth 13 (see FIG. 4) to constrain reverse rotation.

The resiliently deflectable member 23 of the cover 2 can be a spring arm. The spring arm is formed in the cover 2 by forming an upward-facing opening 22 in the second coupling section 21 in such a way that the spring arm projects from one side wall of the opening 22 and extends in a direction substantially parallel to a direction along which the base 1 and the cover 2 are relatively rotated for screwing engagement. (In other words, the direction in which the base 1 and the cover 2 are rotated for screwing engagement is different from a direction in which the resiliently deflectable member 23 is resiliently deflectable. For example, the rotation direction is a lateral direction while the deflection direction is a longitudinal direction so that the counterpart straight side 241 of the resiliently deflectable member 23 may affect constraint against reverse rotation in the direction of rotation for screwing engagement.) The spring arm has a free end that is raised upward to form the counterpart tooth 24 in such a way that the counterpart straight side 241 of the counterpart tooth 24 is formed at a distal end of the spring arm.

The first coupling section 11 of the base 1 is a circumferentially-extending recess and the second coupling section 21 of the cover 2 is a raised rim corresponding to the recess. (It is apparent that such an arrangement can be reversed so that the second coupling section 21 of the cover 2 is a circumferentially-extending recess, while the first coupling section 11 of the base 1 is a raised rim corresponding to the recess, both being not shown in the drawings.) The recess and the rim mate each other. Further, the first coupling section 11 of the base 1 and the second coupling section 21 of the cover 2 may be additionally provided therebetween with an O-ring 3 to provide a function of protection against invasion of humidity or water into the shell of the light bulb.

The detachment-resistant shell of light bulb according to the present invention provides the following features. The base 1 and the cover 2 are respectively provided with the first and second coupling sections 11, 21 that are relatively rotatable for screwing engagement with each other and a unique structure, including the teeth 13 and the resiliently deflectable member 23 comprising the counterpart tooth 24, is provided between the first and second coupling sections 11, 21 to prevent reverse rotation of the bulb shell, whereby when the cover 2 is jointed to the lower opening of the base 1 through screwing engagement, the inclined sides of the teeth 13 and the counterpart tooth 24 (namely the hypotenuses of the right angles) allows of smooth rotation. When the rotation reaches the final position, due to the counterpart straight side 241 of the resiliently deflectable member 23 being in engagement with the straight side 131 of one of the teeth 13 (see FIG. 4), the cover 2 is prevented from reverse rotation so that the bulb shell does not get loosened and detached or falling off. An O-ring 3 is arranged between the first coupling section 11 and the second coupling section 21 so that due to the detachment resistance of the bulb shell, the mating engagement between the base 1 and the cover 2 is secured and the O-ring 3 realizes protection against invasion of water and leakage so that humidity and water are prevented from entering the bulb. Thus, even in an application in which heavy humidity or corrosive gas exists, a light bulb comprising the bulb shell according to the present invention may protect electronic components contained in the bulb from being corroded and damaged.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A detachment-resistant shell of light bulb, comprising:

a base, which has a lower end forming an opening around which a first coupling section is circumferentially formed, the first coupling section having a side face around which a thread is circumferentially formed, the first coupling section having a top face on which a plurality of teeth is formed and distributed circumferentially, each of the teeth having a straight side; and a cover, which has an upper end forming an opening that forms a second coupling section corresponding to and engageable with the first coupling section, the second coupling section having a counterpart side face that corresponds to the side face and around which a counterpart thread is circumferentially formed to correspond to and be engageable with the thread, the second coupling section having a counterpart top face that corresponds to the top face and forms at least one resiliently deflectable member, the resiliently deflectable member being provided with a counterpart tooth that corresponds to and is engageable with the teeth, the counterpart tooth comprising a counterpart straight side corresponding to the straight side, the counterpart straight side of the counterpart tooth being selectively engageable with the straight side of one of the teeth to constrain reverse rotation.

2. The detachment-resistant shell of light bulb as claimed in claim 1, wherein the resiliently deflectable member of the cover comprises a spring arm.

3. The detachment-resistant shell of light bulb as claimed in claim 2, wherein the second coupling section of the cover forms an opening, the spring arm projecting from a side wall of the opening, the spring arm being substantially parallel with a direction in which the base and the cover are relatively rotatable for screwing engagement, the spring arm having a free end that is raised upward to form the counterpart tooth.

4. The detachment-resistant shell of light bulb as claimed in claim 1, wherein one of the first coupling section of the base and the second coupling section of the cover is a circumferentially-extending recess and the other of the first coupling section of the base the second coupling section of the cover is a raised rim corresponding to the recess, the recess and the rim being mateable with each other.

5. The detachment-resistant shell of light bulb as claimed in claim 1, wherein the side face of the first coupling section of the base is an inside surface and the counterpart side face of the second coupling section of the cover is an outside surface.

6. The detachment-resistant shell of light bulb as claimed in claim 1, wherein the teeth of the first coupling section of the base and the counterpart tooth of the second coupling section of the cover are of a shape of right angle.

7. The detachment-resistant shell of light bulb as claimed in claim 1, wherein the direction in which the base and the cover are relatively rotatable for screwing engagement is different from a deflection direction of the resiliently deflectable member.

8. The detachment-resistant shell of light bulb as claimed in claim 1 further comprising an O-ring mounted between the first coupling section of the base and the second coupling section of the cover for water resistance.

* * * * *